US006902167B2

(12) United States Patent
Webb

(10) Patent No.: US 6,902,167 B2
(45) **Date of Patent: *Jun. 7, 2005**

(54) METHOD AND APPARATUS FOR PLAYING BLACKJACK WITH A 3- OR 5-CARD NUMERICAL SIDE WAGER ("21+3/5 NUMERICAL")

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/685,601

(22) Filed: Oct. 16, 2003

(65) Prior Publication Data

US 2004/0080110 A1 Apr. 29, 2004

Related U.S. Application Data

(60) Continuation-in-part of application No. 10/281,113, filed on Oct. 28, 2002, which is a continuation of application No. 09/845,312, filed on May 1, 2001, now Pat. No. 6,481,719, which is a continuation-in-part of application No. 09/464,778, filed on Dec. 16, 1999, now Pat. No. 6,371,867, which is a continuation-in-part of application No. 09/118,067, filed on Jul. 17, 1998, now Pat. No. 6,012,719, which is a continuation-in-part of application No. 08/889,919, filed on Jul. 10, 1997, now Pat. No. 6,056,641, which is a division of application No. 08/504,023, filed on Jul. 19, 1995, now Pat. No. 5,685,774.

(51) Int. Cl.[7] ..... A63F 1/00
(52) U.S. Cl. ..... 273/292; 273/274
(58) Field of Search ..... 273/292, 309, 273/274; 463/12, 13

(56) References Cited

U.S. PATENT DOCUMENTS

| | | | |
|---|---|---|---|
| 4,743,022 | A | 5/1988 | Wood |
| 4,836,553 | A | 6/1989 | Suttle et al. |
| 4,861,041 | A | 8/1989 | Jones et al. |
| 5,022,653 | A | 6/1991 | Suttle et al. |

(Continued)

FOREIGN PATENT DOCUMENTS

| | | |
|---|---|---|
| GB | 667345 | 2/1952 |

OTHER PUBLICATIONS

"Over/Under 13", Gaming Concepts, Inc., 1998.

Scarne, John, "Scarne's Encyclopedia of Games", Harper & Row, Publishers, pp. 278–281.

*Primary Examiner*—Benjamin Layno
(74) *Attorney, Agent, or Firm*—Nixon & Vanderhye P.C.

(57) ABSTRACT

A card game combines the play of Blackjack ("21") with a side wager. Each player places a basic Blackjack wager and an optional side wager before the cards are dealt. Each player is dealt at least one hand of two cards with the dealer receiving a face-up card. A side wager hand consists of the at least one 2-card hand dealt to that player and the dealer's face-up card. The side wager hand is resolved according to a numerical total of the hand and in some embodiments also a Poker rank. Subsequently, the game of Blackjack continues in a typical fashion. The invention advantageously retains all the features and advantages of Blackjack as well as provides the dynamics of novel side wager, without interfering with the card sequence, for enhanced player anticipation and enjoyment.

24 Claims, 2 Drawing Sheets

U.S. PATENT DOCUMENTS 5,046,736 A 9/1991 Bridgman et al.
5,098,107 A 3/1992 Boylan et al.
5,174,579 A 12/1992 Griffiths
5,257,784 A 11/1993 Boylan et al.
5,257,810 A 11/1993 Schorr et al.
5,265,877 A 11/1993 Boylan et al.
5,275,415 A 1/1994 Wisted
5,275,416 A * 1/1994 Schorr et al. ..... 273/292
5,288,081 A 2/1994 Breeding
5,294,128 A 3/1994 Marquez
5,308,065 A 5/1994 Bridgeman et al.
5,366,228 A 11/1994 Kangsanaraks
5,377,973 A 1/1995 Jones et al.
5,377,993 A 1/1995 Josephs
5,431,408 A 7/1995 Adams
5,489,101 A 2/1996 Moody
5,531,448 A 7/1996 Moody
5,538,252 A 7/1996 Green
5,584,486 A 12/1996 Franklin
5,613,682 A * 3/1997 Otuzbiryan ..... 273/292
5,630,757 A 5/1997 Gagin et al.
5,653,444 A 8/1997 Dahl
5,673,917 A 10/1997 Vancura
5,678,821 A 10/1997 Hedman
5,685,774 A 11/1997 Webb
5,732,950 A 3/1998 Moody
5,743,530 A 4/1998 Sklad et al.
5,839,730 A 11/1998 Pike
5,873,571 A 2/1999 Vaisman et al.
6,012,719 A 1/2000 Webb
6,056,641 A 5/2000 Webb
6,371,867 B1 4/2002 Webb
6,481,719 B2 * 11/2002 Webb ..... 273/292
6,592,125 B1 * 7/2003 Lizak ..... 273/292
6,609,711 B1 * 8/2003 Campbell ..... 273/274
2003/0050106 A1 * 3/2003 Lyfoung ..... 463/13

* cited by examiner

METHOD AND APPARATUS FOR PLAYING BLACKJACK WITH A 3- OR 5-CARD NUMERICAL SIDE WAGER ("21+3/5 NUMERICAL")

CROSS-REFERENCES TO RELATED APPLICATIONS

This is a continuation-in-part (CIP) of U.S. patent application Ser. No. 10/281,113, filed Oct. 28, 2002; which is a continuation of U.S. patent application Ser. No. 09/845,312, filed May 1, 2001, now U.S. Pat. No. 6,481,719; which is a CIP of U.S. patent application Ser. No. 09/464,778, filed Dec. 16, 1999, now U.S. Pat. No. 6,371,867; which is a CIP of U.S. patent application Ser. No. 09/118,067, filed Jul. 17, 1998, now U.S. Pat. No. 6,012,719; which is a CIP of U.S. patent application Ser. No. 08/889,919, filed Jul. 10, 1997, now U.S. Pat. No. 6,056,641; which is a division of U.S. patent application Ser. No. 08/504,023, filed Jul. 19, 1995, now U.S. Pat. No. 5,685,774, the entire contents of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The invention relates to card games. More particularly, the invention relates to Blackjack variant card games.

With the expansion of gaming and the increase in competition, casinos are striving to offer a wider variety of games. The growth in slot machine popularity and the increase in variety of specialty games has resulted in the overall reduction in conventional Blackjack ("21") tables.

Many casinos, however, are reluctant to further reduce the number of Blackjack tables because of the inherent game attractiveness to both players and casinos. The game is based on simple concepts and procedures that are readily understood by casual and regular players alike. In addition, the game allows players to use basic strategies that provide some degree of player control and that allow for heightened excitement. For the casino operators, the game requires relatively low overhead to facilitate and monitor.

In an attempt to accommodate the desire for variety and the retention of a significant Blackjack presence, several Blackjack variant games have been introduced. These games include Multiple Action Blackjack, Spanish 21, Face-Up 21, and Royal Match. See, e.g., U.S. Pat. No. 5,673,917 to Vancura. Although Blackjack variants typically provide additional waging options, these games tend to either negatively alter the flow of the Blackjack game or add very little game dynamics. Another Blackjack variant is Action Gaming's 21 Stud. In this game, each player has the option of placing a side wager in addition to the basic Blackjack wager. The side wager is a bet that a dealer's 5-card hand will be above a certain rank and has a variable payoff scale according to rank. Since a Blackjack player may be satisfied with a hand before being dealt 5-cards (e.g., when the player is dealt an Ace and a Jack for the first two cards), 21 Stud provides for a dealer settling all Blackjack wagers after standing or busting. The game then allows the dealer to draw extra cards, if necessary until having a total of 5 cards. The dealer's first 5 cards form a Poker hand. A standing hand occurs on the odd occasions that more than 5 cards were required for the dealer to reach 17 or more.

21 Stud, however, has several drawbacks. Firstly, because all players with the side wager are betting on the same outcome, the game is very volatile. Secondly, with the range of payoff odds required with a 5-card game, there is a risk of a high payoff amount. Accordingly, the game will likely never be offered with a $1 side bet and may require extra surveillance. Thirdly, the Blackjack hand is the primary part of the game for the majority of players. However, Blackjack wagers are settled first, so the potential anticipatory thrill time is lower on the primary wager. Fourthly, when 5-card hands are dealt face-up, one at a time, there is usually very little excitement because after 3 cards it is often obvious that a premium hand cannot be created. For example when the first 3 cards dealt are 10, 5, and 2 (off-suit), no straight, flush, full house or better are possible. Fifthly, and probably most significantly, the dealer is usually required to take extra cards. This aspect of the game is particularly problematic because it slows the game down and deters potential players who are generally adverse to waiting for other players or the dealer from taking additional cards and those potential players who do not like the run of cards to be altered.

BRIEF SUMMARY OF THE INVENTION

The invention provides card games that combine the play of Blackjack ("21") with a 3- or 5-card side wager ("21+3" or "21+5" respectively) encompassing hands ranked by numerical values and possible also Poker rankings. In a casino embodiment, the invention can be played in conjunction with a conventional Blackjack casino-type table and at least a single standard deck of 52 playing cards. The table surface not only has the regular Blackjack bet area, but also an extra bet area for an optional side wager. In such an embodiment, the table also displays a payoff scale on the side wager and further instructional and promotional information.

At the beginning of a game, each player places a basic Blackjack wager and an optional 3-card side wager, or in the 5-card embodiment, each player places two basic Blackjack wagers for two Blackjack hands and an optional 5-card side wager. A dealer deals each player a card for each hand, with the dealer receiving a face-up card.

Each player also receives a second card for each hand. A player's 3-card hand consists of the 2-card hand dealt to that player and the dealer's face-up card, while in the 5-card embodiment, the player's 5-card hand consists of two 2-card hands dealt to a single player and the dealer's face-up card. At this point, the outcomes of the 3- or 5-card hands are determined according to a total numerical value of the hands, either alone or also in conjunction with Poker rankings. After settling the side wagers, the game of Blackjack continues.

The invention advantageously retains all the features and advantages of Blackjack (and Blackjack variants) as well as provides the dynamics of 3- or 5-card side game, without interfering with the card sequence, for enhanced player anticipation and enjoyment. The invention thus benefits the player who desires a novel side game as well as the player who does not want to leave a Blackjack game, but desires some variety. In addition, the invention provides casino operators with added revenue generating features without requiring additional casino tables, space, or extra game surveillance.

The invention can be readily implemented in a wide variety of additional forms and media including, single player slot video machines, multi-player slot video machines, electronic games and devices, lottery terminals, scratch-card formats, software as well as in-flight, home, and Internet entertainment. Moreover, the invention can be readily implemented in software, which can be stored on a disk (e.g., magnetic disk, compact disc (CD), etc.) and used with a computer system.

The foregoing, and other features and advantages of the invention, will be apparent from the following, more particular description of the preferred embodiments of the invention, the accompanying drawing, and the appended claims.

BRIEF DESCRIPTION OF THE DRAWINGS

These and other aspects and advantages of the present invention will be described in detail with reference to the accompanying drawings, in which.

DETAILED DESCRIPTION OF THE INVENTION

The preferred embodiments of the invention are now described with reference to the figure where like reference numbers indicate like elements.

Figure 1:
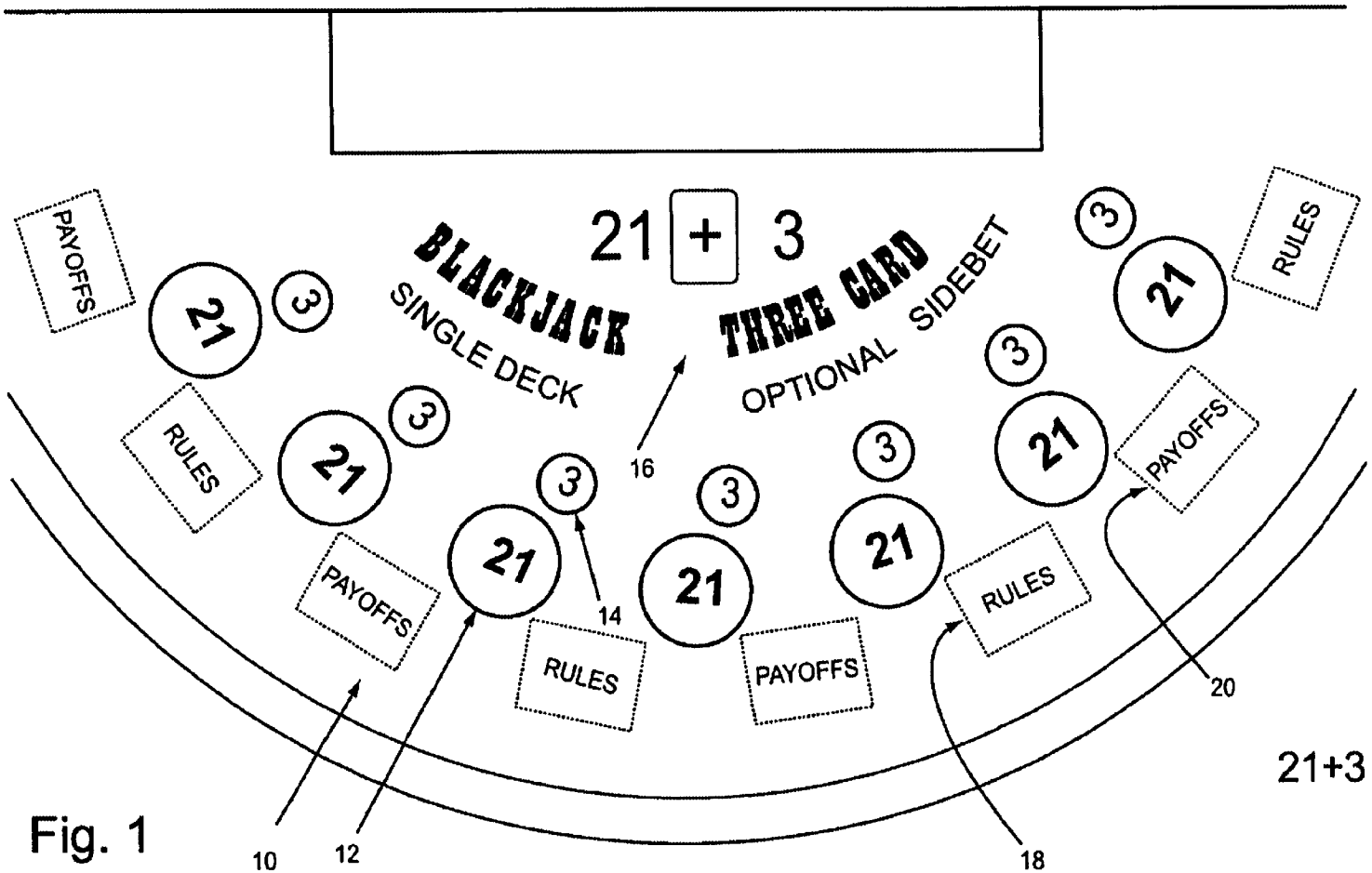
FIG. 1 illustrates a playing surface (layout) of a casino-type table in accordance with a first embodiment of the invention.

The invention will be described in the context of a 3-card side wager, although the principles of the invention are equally applicable to a 5-card side wager, for example as described in U.S. patent application Ser. No. 10/368,412, the disclosure of which is hereby incorporated by reference. The invention provides card games that combine the play of Blackjack ("21") with a side wager. One preferred embodiment of the invention is used in connection with a casino-type Blackjack table and a single standard deck of 52 playing cards. FIG. 1 illustrates a playing surface (layout) 10 of the Blackjack table which includes a primary betting area 12 for each of a plurality of players, which in this embodiment is seven players. Primary betting area 12 is used for the placement of a Blackjack wager. Playing surface 10 also includes a secondary betting area 14, corresponding with each area 12, for an optional 3-card side wager. In addition, playing surface 10 includes a dealer area 16, displays of a predetermined payoff scale 20, and displays of predetermined game rules 18. As would be apparent to one skilled in the relevant art, the predetermined payoff scales and game rules used in a particular embodiment can be based on the teachings of the invention and well known gaming principles and casino specific requirements. Other wager areas and/or information can be displayed on playing surface 10, such as the "21+3" promotional markings illustrated in FIG. 1.

In this embodiment, each player must place a Blackjack wager at betting area 12 in order to participate in the game. Each player, however, has the option to place an additional 3-card side wager at betting area 14. In another embodiment of the invention, both the Blackjack and side wagers are required, and in yet another embodiment only the side wager is required. Additional wagers and wager features can be practiced with the invention.

The allowable limit of the 3-card side wager (placed in area 14) is both governed by predetermined game rules 20 and relative to the Blackjack wager (placed in area 12). For example, with each player having a separate hand and with a payoff scale with a highest payoff similar to Craps or Roulette, an embodiment of the invention can be operated with a minimum 3-card side wager equal to a table minimum for Blackjack, typically $5 or more. In addition, a maximum 3-card side wager for a player can be set to the first hand 3-card side wager made by that player after each shuffle or at the beginning of that shoe. This would negate the impact of well known techniques such as card counting, shuffle tracking, and card locating used by proficient players.

Once the wagers have been placed, a dealer then deals, in rotation, each player a first card and the dealer receives a face-up card. Each player, again in rotation, is then dealt a second card and the dealer receives a second card face-down. Alternatively, the second face-down card can be retained in the deck. In accordance with the invention, a 3-card side wager hand consists of the 2-card hand that player was dealt and the dealer's face-up card.

Thus at this point, the outcomes of the 3-card side wagers are determined and settled prior to continuing with the Blackjack game. In a preferred embodiment, a player wins the 3-card side bet based on a total numerical value of the player's side wager hand, with Aces having a value of exactly 11, exactly 1, or either 11 or 1, face cards having a value of 10, and all other cards having face value. In other playing modes, winning hands may be determined based on a combination of numerical value and Poker ranks. Examples of embodiments and hands ranked in sequence follow.

(1) High Ranks — Ace = 11
33
32
31
30

(2) High and Poker Ranks — Ace = 11

| | | |
|---|---|---|
| 33 | Suited | Natural Three Aces |
| 32 | Suited | |
| 31 | Suited and Sequential | Ace King Queen |
| 31 | Sequential | |
| 31 | Suited | |
| 30 | Suited Three of a Kind | |
| 30 | Suited Sequential | |
| 30 | Sequential | |
| 30 | Suited | |

(3) High with High and Poker Ranks — Ace = 11
As (2) with subsequent ranks being as (1), ranks excluding 33

(4) High and Low

| Ace = 11 or 1 | | Ace = 11 only | | Ace = 1 only | |
|---|---|---|---|---|---|
| Low | High | Low | High | Low | High |
| 3 | As (1) | 6 | As (1) | 3 | 30 |
| 4 | | 7 | | 4 | 29 |
| 5 | | 8 | | 5 | 28 |
| 6 | | 9 | | 6 | 27 |
| 7 | | 10 | | 7 | |
| 8 | | 11 | | 8 | |
| 9 | | 12 | | 9 | |
| | | 13 | | | |
| | | 14 | | | |
| | | 15 | | | |

(5) High and Low with Poker Ranks
As (4) except with Poker Ranks (6) High and Low with High and Low and Poker Ranks
As (5) except with subsequent ranks being as (4) excluding 3 and 33

Card counting may have an impact on vulnerability of wagers on numerical totals. An automatic shuffler may be implemented to eliminate this concern.

As would be apparent to one skilled in the relevant art, alternative payoff scales (e.g., in accordance with the particular casino requirements) can be practiced with the invention. In addition, multiple decks including double deck, four-deck, six-deck, and eight-deck modes can be used with appropriate predetermined payoff scales.

After settling the 3-card side wagers, the dealer proceeds with a Blackjack game. In this embodiment, the Blackjack game is conventional. However, other variant Blackjack games can be practiced with the invention. The Blackjack wagers are settled in accordance with well known principles and the particular aspects of the Blackjack (or Blackjack variant) game.

Figure 2:
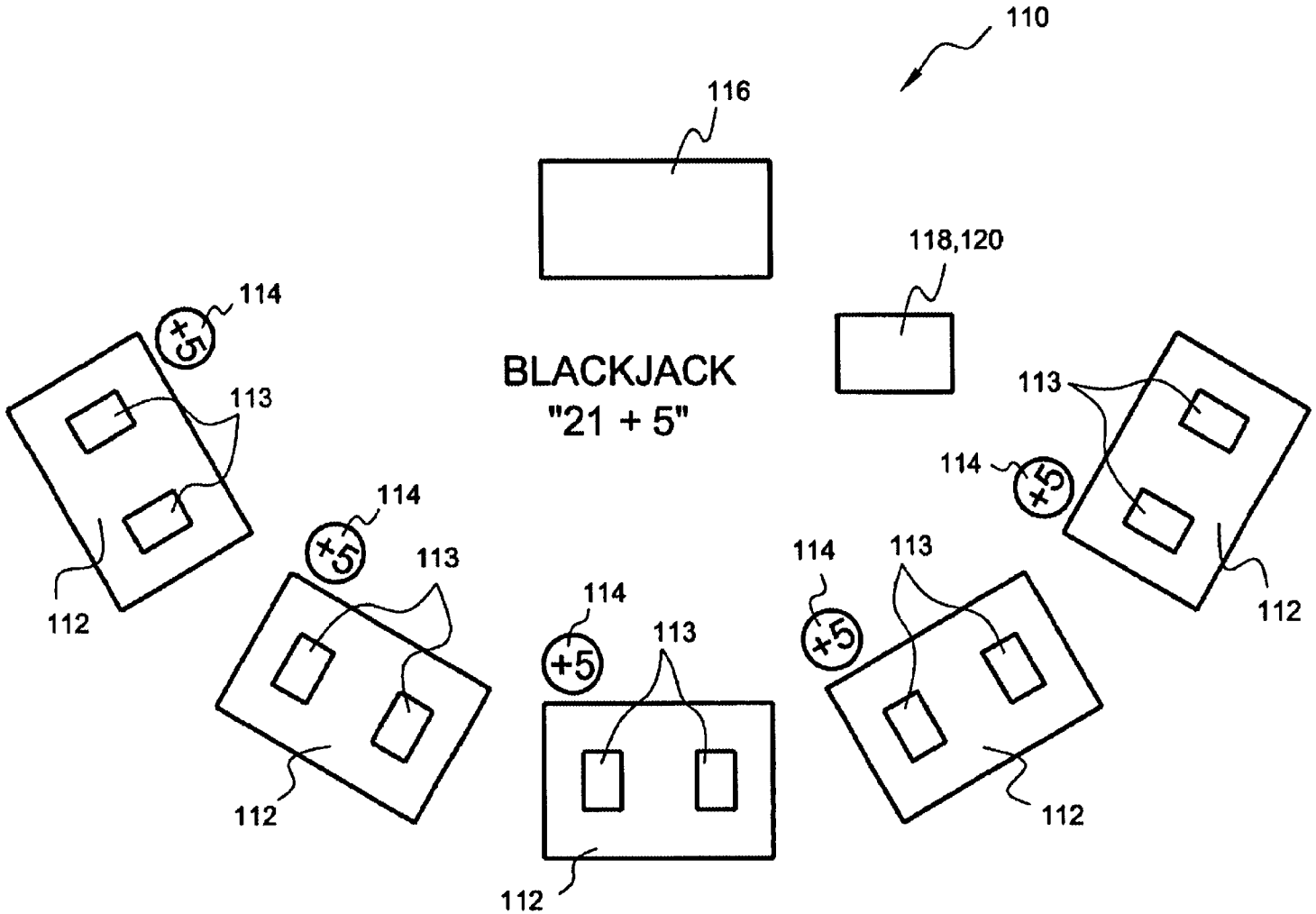
FIG. 2 illustrates a playing surface (layout) of a casino-type table in accordance with a second embodiment of the invention.

As noted above, a second embodiment of the invention incorporates a 5-card playing mode. FIG. 2 illustrates an alternative playing surface (layout) 110 of the Blackjack table which includes a primary betting area 112 for each of a plurality of players, which in this embodiment is five players. Primary betting area 112 includes two wager areas 113 for the placement of a Blackjack wager on each of two hands. According to this embodiment of the invention, in order to place the side wager, each player is required to play and wager on two Blackjack hands. Playing surface 110 also includes a secondary betting area 114, corresponding with each area 112, for an optional 5-card side wager. In addition, playing surface 110 includes a dealer area 116, displays of a predetermined payoff scale 120, and displays of predetermined game rules 118. As would be apparent to one skilled in the relevant art, the predetermined payoff scales and game rules used in a particular embodiment can be based on the teachings of the invention and well known gaming principles and casino specific requirements. Other wager areas and/or information can be displayed on playing surface 110, such as the "21+5" promotional markings illustrated in FIG. 2.

In this embodiment, each player must place at least one Blackjack wager at betting area 112 in order to participate in the game and two Blackjack wagers at betting area 112 in order to place the 5-card side wager. Each player who placed two Blackjack wagers then has the option to place an additional 5-card side wager at betting area 114. In another embodiment of the invention, both the Blackjack and side wagers may be required.

Once the wagers have been placed, a dealer then deals, in rotation, each player a first card for each hand and the dealer receives a face-up card. Each player, again in rotation, is then dealt a second card for each hand and the dealer receives a second or hole card (face-down). Alternatively, the second face-down card can be retained in the deck. In accordance with the invention, a 5-card side wager hand consists of the two 2-card hands that player was dealt and the dealer's face-up card.

The outcomes of the 5-card wagers are then determined and settled prior to continuing with the Blackjack game. In one embodiment, a player wins the 5-card side wager according to numerical totals of the 5-card side wager hand, similar to those discussed above in the 3-card embodiment, although adjusted for 5-card play.

The 5-card wagers are now settled. If the player has a losing 5-card hand, their bet (from area 114) is removed. If the player has a winning 5-card hand, the player is paid in accordance with the predetermined game rules, predetermined payoff scale or the like, and the amount of their bet placed in area 114. As would be apparent to one skilled in the relevant art, alternative payoff scales (e.g., in accordance with the particular casino requirements) can be practiced with the invention.

As in the 3-card embodiment, after settling the 5-card wagers, the dealer proceeds with a Blackjack game.

The invention advantageously retains all of the features and advantages of Blackjack as well as provides the dynamics of a 3-card or 5-card side game, without interfering with the card sequence, for enhanced player anticipation and enjoyment. The invention thus benefits the player who desires a 3- or 5-card side game as well as the player who does not want to leave a Blackjack game, but desires some variety. In addition, the invention provides casino operators with additional revenue generating features for Blackjack with acceptable volatility.

Another predominate feature of the invention is that casino embodiments of invention do not require additional space or tables to practice the invention, rather the invention can be practiced with existing tables, preferably modified as illustrated in FIGS. 1 and 2.

An additional feature is that the invention does not require any more game surveillance than a conventional Blackjack game.

As would be apparent to one skilled in the relevant art, the invention can be embodied in a wide variety of forms and media including, but not limited to, single player slot video machines, multi-player slot video machines, electronic games and devices, lottery terminals, scratch-card formats, software as well as in-flight, home, and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing a card game with one or more decks of playing cards, the method comprising the steps of:

(a) dealing at least one hand of two cards to a player and a card to a dealer;

(b) forming a side wager hand, including said at least one hand of two cards dealt to said player and said card dealt to said dealer;

(c) resolving said side wager hand based on a numerical total of said side wager hand; and (d) continuing with a Blackjack game.

2. A method according to claim 1, wherein the one or more decks of playing cards comprises Aces, each having a value of eleven (11), face cards, each having a value of ten (10), and numerical cards having face value, and wherein step (a) comprises dealing only one hand of two cards to the player.

3. A method according to claim 2, wherein step (c) is practiced by declaring the side wager hand a winner if the numerical total of the side wager hand is a value of H or higher.

4. A method according to claim 3, wherein H is thirty (30).

5. A method according to claim 2, wherein step (c) is practiced by resolving said side wager hand based on a numerical total of said side wager hand and a Poker rank of said side wager hand.

6. A method according to claim 5, further comprising, prior to step (a), the step of receiving at least a side wager from said player.

7. A method according to claim 6, wherein step (c) is practiced by paying a payout based on said side wager in increasing amounts according to hand ranks as follows:

| Total | Poker |
|---|---|
| 30 | suited |
| 30 | sequential |
| 30 | suited and sequential |
| 30 | suited three of a kind |
| 31 | suited |
| 31 | sequential |
| 31 | suited and sequential |
| 32 | suited |
| 33 | suited. |

8. A method according to claim 6, wherein step (c) is practiced by paying a payout based on said side wager in increasing amounts according to hand ranks as follows:

| Total | Poker |
|---|---|
| 30 | |
| 31 | |
| 32 | |
| 30 | suited |
| 30 | sequential |
| 30 | suited and sequential |
| 30 | suited three of a kind |
| 31 | suited |
| 31 | sequential |
| 31 | suited and sequential |
| 32 | suited |
| 33 | suited. |

9. A method according to claim 2, wherein step (c) is practiced by declaring the side wager hand a winner if the numerical total of the side wager hand is either (i) a value of H or higher or (ii) a value of L or lower.

10. A method according to claim 9, wherein H is thirty (30), and wherein L is fifteen (15).

11. A method according to claim 1, wherein the one or more decks of playing cards comprises Aces, each having a value of either one (1) or eleven (11), face cards, each having a value of ten (10), and numerical cards having face value, and wherein step (a) comprises dealing only one hand of two cards to the player.

12. A method according to claim 11, wherein step (c) is practiced by declaring the side wager hand a winner if the numerical total of the side wager hand is either (i) a value of H or higher or (ii) a value of L or lower.

13. A method according to claim 1, wherein the one or more decks of playing cards comprises Aces, each having a value of one (1), face cards, each having a value of ten (10), and numerical cards having face value, and wherein step (a) comprises dealing only one hand of two cards to the player.

14. A method according to claim 13, wherein step (c) is practiced by declaring the side wager hand a winner if the numerical total of the side wager hand is either (i) a value of H or higher or (ii) a value of L or lower.

15. A method according to claim 1, wherein step (c) is practiced by declaring the side wager hand a winner if the numerical total of the side wager hand exceeds a predetermined amount.

16. A method according to claim 1, wherein step (c) is practiced by declaring the side wager hand a winner if the numerical total of the side wager hand is less than a predetermined amount.

17. A method according to claim 1, wherein step (c) is practiced by declaring the side wager hand a winner if the numerical total of the side wager hand either exceeds a predetermined amount or is less than a predetermined amount.

18. A method according to claim 1, wherein step (c) is practiced by resolving said side wager hand based on a numerical total and a Poker rank of said side wager hand.

19. A method according to claim 1, further comprising, prior to step (a), the step of receiving at least a side wager from said player, wherein step (c) is practiced by paying a payout for a winning side wager hand based on said side wager.

20. A method according to claim 1, wherein step (a) is practiced by dealing two hands of two cards to the player, and wherein step (b) is practiced by forming the side wager hand including said two hands of two cards dealt to said player and said card dealt to said dealer.

21. A method according to claim 20, wherein step (c) is practiced by resolving said side wager hand based on a numerical total and a Poker rank of said side wager hand.

22. A method of playing a Blackjack casino card game including a side wager without affecting the underlying Blackjack game, the method comprising:

(a) receiving at least a side game wager from a player;

(b) dealing at least one hand of two cards to a player and a card to a dealer;

(c) forming a side wager hand, including said at least one hand of two cards dealt to said player and said card dealt to said dealer;

(d) resolving said side wager hand based on a numerical total of said side wager hand by paying a payout based on said side game wager when the numerical total exceeds a predetermined total, said payout increasing with increasing numerical totals; and (e) continuing with the Blackjack game.

23. A method of playing a card game with one or more decks of playing cards, the method comprising the steps of:

(a) dealing at least one hand of two cards to a player;

(b) dealing a non-player card;

(c) forming a side wager hand, including said at least one hand of two cards dealt to said player and said non-player card;

(d) resolving said side wager hand based on a numerical total of said side wager hand; and (e) continuing with a Blackjack game.

24. A method according to claim 23, wherein step (b) is practiced by dealing a card to a dealer.

* * * * *